US005701072A

United States Patent [19]

Jeon et al.

[11] Patent Number: 5,701,072

[45] Date of Patent: Dec. 23, 1997

[54] INTEGRATED CIRCUIT OUTPUT DRIVER SYSTEMS INCLUDING MULTIPLE POWER AND GROUND LINES

[75] Inventors: Jun-Young Jeon, Seoul; Pil-Soon Park, Kyungki-do, both of Rep. of Korea

[73] Assignee: Samsung Electronics Co., Ltd., Suwon, Rep. of Korea

[21] Appl. No.: 702,130

[22] Filed: Aug. 23, 1996

[30] Foreign Application Priority Data

Aug. 24, 1995 [KR] Rep. of Korea ..... 95 26277

[51] Int. Cl.[6] ..... G05F 3/04; H01H 3/26

[52] U.S. Cl. ..... 323/312; 327/384; 326/33

[58] Field of Search ..... 323/312; 363/132; 327/384; 307/140; 365/189.05; 326/26, 33, 91, 101

[56] References Cited

U.S. PATENT DOCUMENTS 4,871,928 10/1989 Bushey ..... 326/110
5,319,252 6/1994 Pierce et al. ..... 327/384
5,532,630 7/1996 Waggoner et al. ..... 326/30
5,610,533 3/1997 Arimoto et al. ..... 326/33

*Primary Examiner*—Stuart N. Hecker
*Attorney, Agent, or Firm*—Bell, Seltzer, Park & Gibson

[57] ABSTRACT

An integrated circuit output driver system includes a first power line channel extending along the integrated circuit. The first power line channel includes a first power supply voltage line and a first ground voltage line. A second power line channel also extends along the integrated circuit and is spaced apart from the first power line channel. The second power line channel includes a second power supply voltage line and a second ground voltage line. A plurality of output drivers are located between the first and second spaced apart power line channels. Each output driver includes an output node, a pull-up circuit which pulls up the output node in response to a pull-up input signal, and a pull-down circuit which pulls down the output node in response to a pull-down input signal. The power supply and ground voltage connections for alternating output drivers are supplied by the first power supply voltage line and the second ground voltage line, and the second power supply voltage line and the first ground voltage line respectively. Switching noise on the power lines may thereby be reduced.

28 Claims, 3 Drawing Sheets

INTEGRATED CIRCUIT OUTPUT DRIVER SYSTEMS INCLUDING MULTIPLE POWER AND GROUND LINES

FIELD OF THE INVENTION

The present invention relates to integrated circuit devices, and more particularly, to integrated circuit output driver systems.

BACKGROUND OF THE INVENTION

Integrated circuit devices such as semiconductor memory devices generally include output driver systems having a plurality of output drivers. Each output driver is generally connected to a pad to transmit internal data from the integrated circuit device to external of the device through the output pad. It will be understood that data can include address, program, information and other signals which are output from an integrated circuit device.

For example, referring to FIG. 1, a conventional semiconductor memory device generally includes a plurality of output drivers DOB1–DOBn connected between a pair of power lines 10, 12. Each output driver DOB1–DOBn includes a pull-up circuit PU1–PUn connected between the power supply voltage line (VDD) 10 and pads PAD1–PADn respectively, and responding to inverted data signals DB1–DBn respectively. When the data signal D1 is at "high" level (logic "1"), the pull-up circuit PU1 is supplied with power from the power supply voltage VDD line 10 and charges the PAD1 to "high" logic state. When the data signal DB1 is at "low" level (logic "0"), the pull-down circuit PD1 drives the PAD1 to "low" logic state by discharging the charged PAD1 into the ground voltage VSS line 12.

In a conventional data output driver system, the plurality of pull-up circuits are commonly connected to the power supply voltage line 10 and the plurality of pull-down circuits are commonly connected to the ground voltage line 12. Accordingly, when data is output, if every data output driver transitions to the pull-up state or to the pull-down state, a large current can suddenly flow in the power lines. In particular, if every pull-up circuit simultaneously is turned on, the power supply voltage line can suddenly lower the level of the power voltage. Conversely, if every pull-down circuit simultaneously is turned on, the ground voltage line can suddenly raise the level of the ground voltage, thereby generating power noise.

Power noise can degrade performance of the output drivers. Those output drivers which are located remote from the power supply pad are particularly impacted by the noise. Moreover, the operation of the semiconductor memory device may slow down, since rapid charging/discharging may be interrupted by the noise.

Noise on the ground voltage line of an output driver of an integrated circuit device generally impacts performance more than noise on the power supply voltage line. Since the power source of the power supply voltage line is supplied from an external power supply system, it generally has a large current driving capability and is generally stable. On the other hand, the ground voltage line can operate as a noise source when the data output driver operates in the memory device. It is known to make the ground voltage line wider than that of the power supply voltage line, but this can create other problems. For example, pad symmetry may no longer be provided. Accordingly, there continues to be a need for integrated circuit output driver systems which can reduce power line noise.

SUMMARY OF THE INVENTION

It is therefore an object of the present invention to provide improved integrated circuit output driver systems.

It is another object of the present invention to provide integrated circuit output driver systems which can reduce noise on the power lines thereof during driver output.

These and other objects are provided, according to the present invention, by an integrated circuit driver system which includes multiple, i.e. more than one, power supply and ground lines for the output drivers which make up the integrated circuit output driver system. The multiple power supply and ground lines can reduce noise on the power lines.

In particular, a first pair of first and second reference voltage lines, such as a first pair of power supply and ground lines, are provided. They preferably extend in parallel and are not collinear. A second pair of first and second reference voltage lines, such as a second pair of power supply and ground lines, are also provided. They also preferably extend in parallel and are not collinear. The second pair of first and second reference voltage lines are spaced apart from the first pair of first and second reference voltage lines. A plurality of output drivers are located in the integrated circuit between the spaced apart first and second pairs of first and second reference lines. Each driver drives an output node in response to an input signal, and each driver is powered by the first and second reference voltages.

Stated differently, a pair of parallel first reference voltage lines and a pair of parallel second reference voltage lines extend adjacent each output driver, and provide power to the output drivers. By providing multiple power and ground lines, noise on the power lines and ground lines may be reduced.

In a preferred embodiment of the present invention, an integrated circuit output driver system includes a first power line channel which extends along the integrated circuit. The first power line channel includes therein a first first reference voltage line, such as a first power supply voltage line and a first second reference voltage line, such as a first ground voltage line. A second power line channel extending along the integrated circuit is spaced apart from the first power line channel. The second power line channel includes therein a second first reference voltage line, such as a second power supply voltage line and a second second reference voltage line, such as a second ground voltage line.

A plurality of output drivers are located between the first and second spaced apart power line channels. Each output driver includes an output node, a pull-up circuit and a pull-down circuit. The pull-up circuit pulls up the output node in response to a pull-up input signal. The pull-up circuit is connected to one of the first first reference voltage line and the second first reference voltage line. In other words, the pull-up circuit is connected to the power supply voltage line in either the first power line channel or the second power line channel.

A pull-down circuit pulls down the output node in response to a pull-down input signal. The pull-down circuit is connected to one of the first second reference voltage line and the second second reference voltage line. In other words, the pull-down circuit is connected to either the ground voltage line in the first channel or the ground voltage line in the second channel.

Preferably, if an output driver is connected to a power supply line from one of the power line channels, it is connected to a ground voltage line from the other of the power line channels. Also preferably, alternating ones of the output drivers are connected to the first first reference voltage line and the first second reference voltage line, and to the second first reference voltage line and the second second reference voltage line. In other words, alternating drivers have their power supply and ground voltages being supplied by alternating ones of the first and second channels.

The output node of each driver preferably drives an associated output pad. The pull-up signal is preferably an output data signal and the pull-down input signal is preferably the complement of the output data signal.

Four different arrangements of the first and second channels may be provided, depending upon which line in the channel is adjacent the output drivers and which line in the channel is remote from the output drivers. In first and second embodiments, the first second reference voltage line is adjacent the plurality of output drivers and the first first reference line is remote from the plurality of output drivers, in the first channel. In the first embodiment, the second second reference voltage line is adjacent the output drivers and the second first reference voltage line is remote from the output drivers, in the second channel. In the second embodiment, the second first reference voltage line is adjacent the output drivers and the second second reference voltage line is remote from the output drivers, in the second channel.

In third and fourth embodiments, the first first reference voltage line is adjacent the output drivers and the first second reference voltage line is remote from the output drivers, in the first channel. In the third embodiment, the second second reference voltage line is adjacent the output drivers and the second first reference voltage line is remote from the output drivers, in the second channel. In a fourth embodiment, the second first reference voltage line is adjacent the second plurality of output drivers and the second second reference voltage line is remote from the plurality of output drivers, in the second channel.

By providing a parallel power and ground line above and below the output drivers in the integrated circuit, and by selectively connecting drivers to power and ground lines from above and below, noise on the power and ground lines may be reduced during switching of the drivers. Improved performance of integrated circuit devices may thereby be provided.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The examples illustrated herein all refer to a semiconductor memory device. However, it will be understood that the invention applies to output drivers of any integrated circuit device. Moreover, although data output drivers are described, it will be understood that the output drivers of the present invention may output any signal, such as addresses, programs and information.

Figure 1:
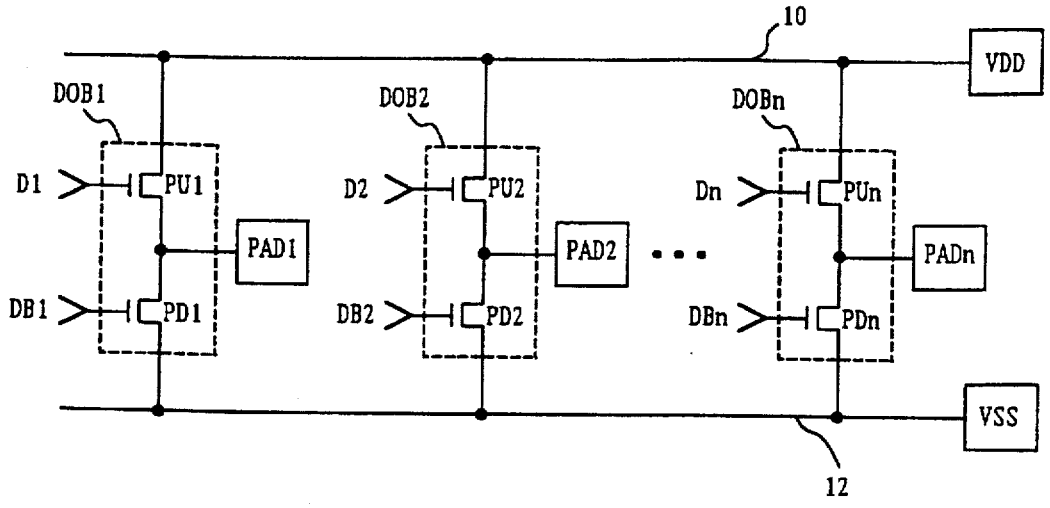
FIG. 1 (Prior Art)
FIG. 1 is a circuit diagram illustrating an output driver system in a conventional integrated circuit device.
Figure 2:
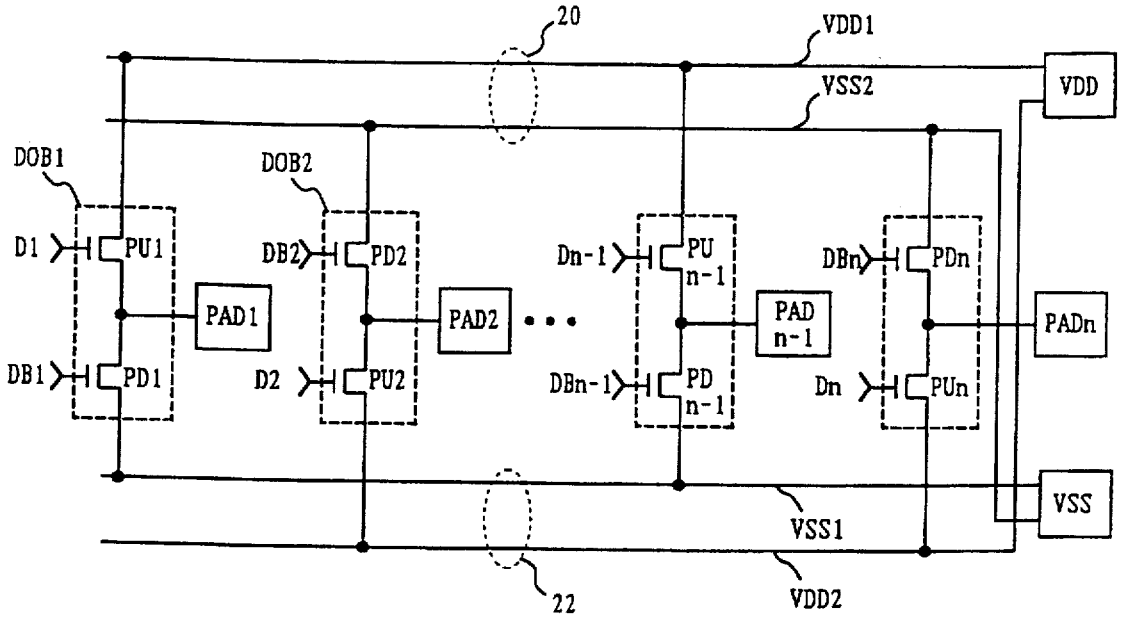
FIG. 2 is a circuit diagram of a first embodiment of an output driver system in an integrated circuit device according to the present invention.

FIG. 2 illustrates a preferred embodiment of a data output driver system according to the present invention. In this embodiment, the data output driver system includes a first power line channel 20, a second power line channel 22, and a plurality of drivers DOB1–DOBn. The first power line channel 20 includes a first power supply voltage line VDD1, and a second ground voltage line VSS2 located between the first power supply voltage line VDD1 and the drivers DOB1–DOBn. As shown, the first power supply voltage line VDD1 and the second ground voltage line VSS2 extend in parallel, and are not collinear. The second power line channel 22 includes a first ground voltage line VSS1, and a second power supply voltage line VDD2 located between the first ground voltage line VSS1 and the drivers DOB1–DOBn. As shown, the first ground voltage line VSS1 and the second power supply voltage line VDD2 extend in parallel and not collinear.

One driver DOBi (where i is odd) includes a pull-up circuit PUi connected between a corresponding power supply voltage line VDD1 of the first power line channel 20 and a corresponding pad PADi from a plurality of pads. Pull-up circuit PUi responds to a data signal Di. A pull-down circuit PDi, connected between a corresponding second ground voltage line VSS1 of the second power line channel 22 and a corresponding pad PADi from a plurality of pads, is pulled down in response to an inverted data signal DBi.

The other driver DOBj (where j is even) includes a pull-down circuit PDj connected between a corresponding second ground voltage line VSS2 of the first power line channel 20 and a corresponding pad PADj from the plurality of pads. Pull-down circuit PDj responds to the inverted data signal DBi. A pull-up circuit PUj, connected between a corresponding second power supply voltage line VDD2 of the second power line channel 22 and a corresponding pad PADj from a plurality of pads, is pulled up in response to the data signal Dj. Preferably, the driver connected between the first power supply voltage line and the first ground voltage line and the driver connected between the second ground voltage line and the second power supply voltage line are alternatingly arranged. It will be understood that the drivers may be alternatingly arranged singly, in pairs, in groups of three, etc.

Figure 3:
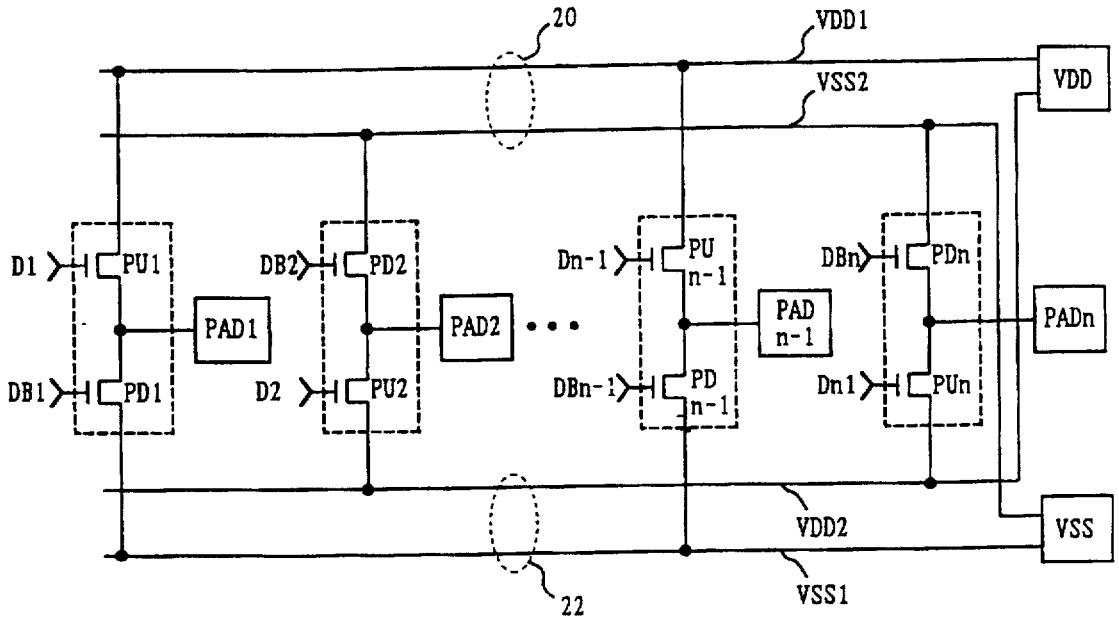
FIG. 3 is a circuit diagram of a second embodiment of an output driver system in an integrated circuit device according to the present invention.

Referring to FIG. 3, the data output driver system includes a first power line channel 20, a second power line channel 22, and a plurality of drivers DOB1–DOBn. The first power line channel 20 includes a first power supply voltage line VDD1, and a second ground voltage line VSS2 located between the first power supply voltage line VDD1 and the drivers DOB1–DOBn. The second power line channel 22 includes a first ground voltage line VSS1, and a second power supply voltage line VDD2 located between the first ground voltage line VSS1 and the drivers DOB1–DOBn.

One driver DOBi (where i is odd) includes a pull-up circuit PUi connected between a corresponding first power supply voltage line VDD1 of the first power line channel 20 and a corresponding pad PADi from a plurality of pads.

Pull-up circuit PUi responds to a data signal Di. A pull-down circuit PDi, connected between a corresponding first ground voltage line VSS1 of the second power line channel 22 and a corresponding pad PADi from a plurality of pads, is pulled down in response to an inverted data signal DBi.

The other driver DOBj (where j is even) includes a pull-down circuit PDj connected between a corresponding second ground voltage line VSS2 of the first power line channel 20 and a corresponding pad PADj from the plurality of pads. Pull-down circuit PDj responds to the inverted data signal DBj. A pull-up circuit PUj, connected between a corresponding second power supply line VDD2 of the second power line channel 22 and a corresponding pad PADj from a plurality of pads, is pulled up in response to the data signal Dj.

Figure 4:
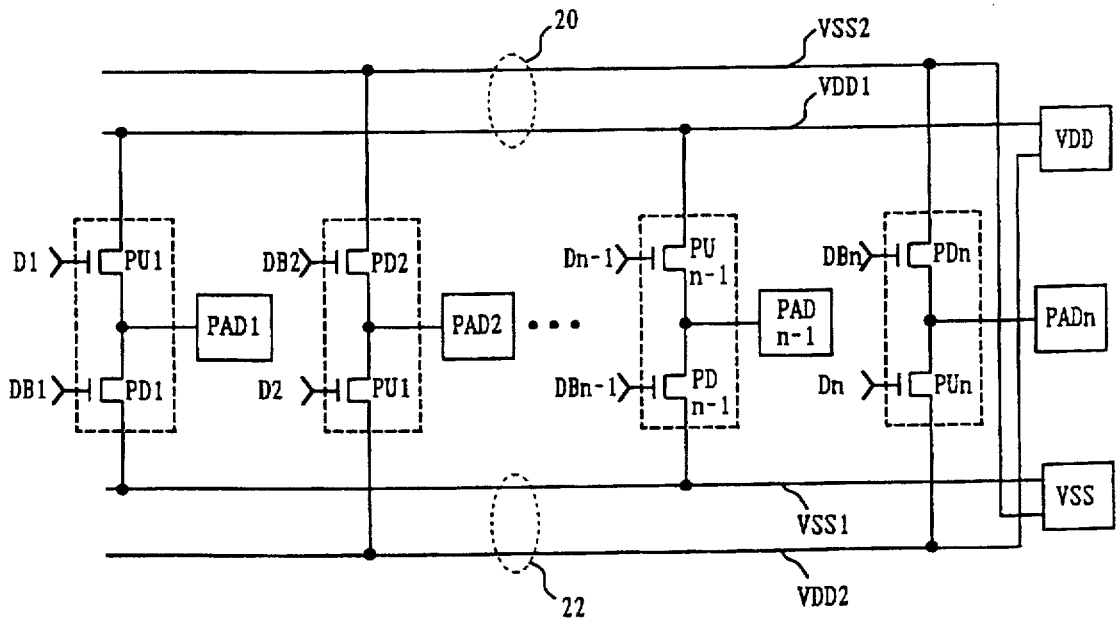
FIG. 4 is a circuit diagram of a third embodiment of an output driver system in an integrated circuit device according to the present invention.

Referring to FIG. 4, the data output driver system includes a first power line channel 20, a second power line channel 22, and a plurality of drivers DOB1–DOBn. The first power line channel 20 includes a second ground voltage line VSS2, and a first power supply voltage line VDD1 located between the second ground voltage line VSS2 and the drivers DOB1–DOBn. The second power line channel 22 includes a second power supply voltage line VDD2, and a first ground voltage line VSS1 located between the second power supply voltage line VDD2 and the drivers DOB1–DOBn.

One driver DOBi (where i is odd) includes a pull-up circuit PUi connected between a corresponding first power supply voltage line VDD1 of the first power line channel 20 and a corresponding pad PADi from a plurality of pads. Pull-up circuit PUi responds to a data signal Di. A pull-down circuit PDi, connected between a corresponding first ground voltage line VSS1 of the second power line channel 22 and a corresponding pad PADi from a plurality of pads, is pulled down in response to an inverted data signal DBi.

The other driver DOBj (where j is even) includes a pull-down circuit PDj connected between a corresponding second ground voltage line VSS2 of the first power line channel 20 and a corresponding pad PADj from the plurality of pads. Pull-down circuit PDj responds to the inverted data signal DBj. A pull-up circuit PUj, connected between a corresponding second power supply voltage line VDD2 of the second power line channel 22 and a corresponding pad PADj from a plurality of pads, is pulled up in response to the data signal Dj.

Figure 5:
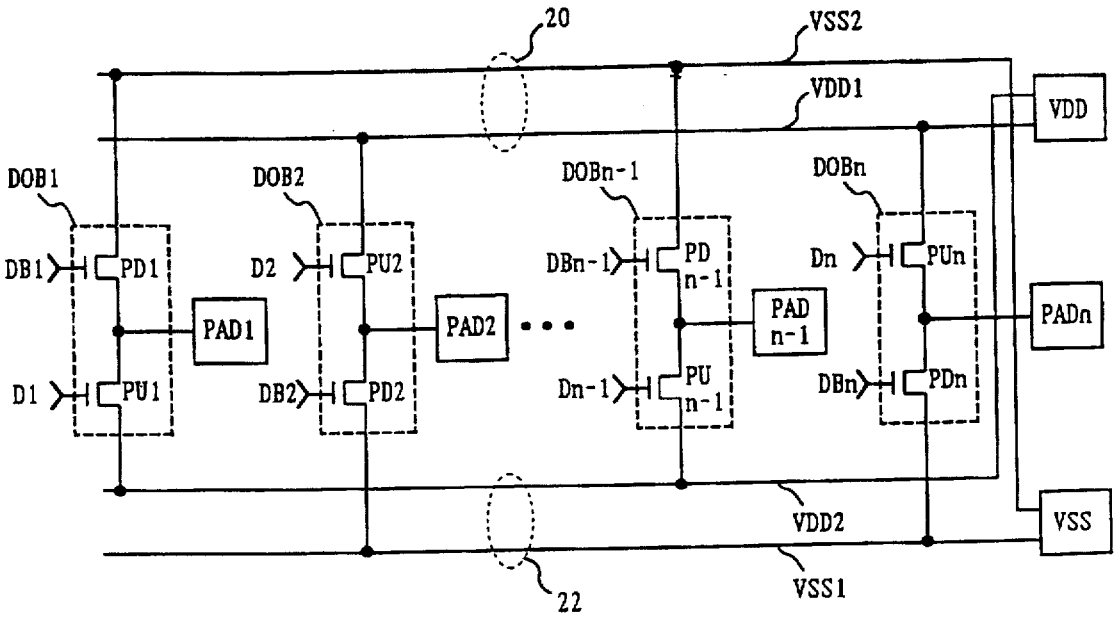
FIG. 5 is a circuit diagram of a fourth embodiment of an output driver in an integrated circuit device according to the present invention.

Referring to FIG. 5, the data output driver system includes a first power line channel 20, a second power line channel 22, and a plurality of drivers DOB1–DOBn. The first power line channel 20 includes a second ground voltage line VSS2, and a first power supply voltage line VDD1 located between the second ground voltage line VSS2 and the drivers DOB1–DOBn. The second power line channel 22 includes a first ground voltage line VSS1, and a second power supply voltage line VDD2 located between the first ground voltage line VSS1 and the drivers DOB1–DOBn.

One driver DOBi (where i is odd) includes a pull-down circuit PDi connected between a corresponding ground voltage line VSS2 of the first power line channel 20 and a corresponding pad PADi from a plurality of pads. Pull-down circuit PUi responds to an inverted data signal DBi. Pull-up circuit PUi, connected between a corresponding second power supply line VDD2 of the second power line channel 22 and a corresponding pad PADi from a plurality of pads, is pulled up in response to a data signal Di.

The other driver DOBj (where j is even) includes a pull-up circuit PUj connected between a corresponding first power supply line VDD1 of the first power line channel 20 and a corresponding pad PADj from the plurality of pads. Pull-up circuit PUj responds to a data signal Dj. A pull-down circuit PDj, connected between a corresponding second ground voltage line VSS1 of the second power line channel 22 and a corresponding pad PADj from a plurality of pads, is pulled down in response to the inverted data signal DBj.

As described above, the present invention arranges power supply voltage lines VDD above and below the pull-up circuits. Ground voltage lines VSS are also provided above and below the pull-down circuits. The power supply voltage VDD of the first driver DOB1 is provided from above and the power supply voltage VDD of the second driver DOB2 is provided from below. The power supply voltage VDD of the third driver DOB3 is provided from above and the power supply voltage VDD of the fourth driver DOB4 is provided from below. Similarly, the ground voltage VSS of the first driver DOB1 is provided from below and the ground voltage VSS of the second driver DOB2 is provided from above. The ground voltage VSS of the third driver DOB3 is provided from below and the ground voltage VSS of the fourth driver DOB4 is provided from above.

Therefore, noise may be reduced by separating the power lines where power line noise is generated. Also, the symmetry of the pads is maintained. Accordingly, data output driver systems of the present invention can produce stable data output characteristics, since maximum noise peaks may be reduced by providing multiple VCC/VSS power lines. The multiple VCC/VSS power lines can reduce the noise which is generated when data is output.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An integrated circuit output driver system comprising:

a first power line channel extending along said integrated circuit, said first power line channel including therein a first first reference voltage line and a first second reference voltage line;

a second power line channel extending along said integrated circuit, and spaced apart from said first power line channel, said second power line channel including therein a second first reference voltage line and a second second reference voltage line;

a plurality of output drivers between said first and second spaced apart power line channels, each of which comprises an output node, a pull-up circuit which pulls up the output node in response to a pull-up input signal and which is connected to one of the first first reference voltage line and the second first reference line, and a pull-down circuit which pulls down the output node in response to a pull-down input signal and which is connected to one of the first second reference voltage line and the second second reference voltage line.

2. An integrated circuit output driver system according to claim 1 wherein said first reference voltage is a power supply voltage and wherein said second reference voltage is ground voltage.

3. An integrated circuit output driver system according to claim 1 further comprising a plurality of output pads, a respective output node being connected to a respective output pad.

4. An integrated circuit output driver system according to claim 1 wherein said pull-up input signal is an output data signal and wherein said pull-down input signal is the complement of said output data signal.

5. An integrated circuit output driver system according to claim 1 wherein said plurality of output drivers are sequentially arranged in the integrated circuit, and wherein alternating ones of said sequentially arranged plurality of output drivers are connected to the first first reference voltage line and the first second reference voltage line, and to the second first reference voltage line and the second second reference voltage line.

6. An integrated circuit output driver according to claim 1 wherein said first second reference voltage line is adjacent said plurality of output drivers and wherein said first first reference voltage line is remote from said plurality of output drivers, in said first channel.

7. An integrated circuit output driver according to claim 6 wherein said second second reference voltage line is adjacent said plurality of output drivers and wherein said second first reference voltage line is remote from said plurality of output drivers, in said second channel.

8. An integrated circuit output driver according to claim 6 wherein said second first reference voltage line is adjacent said plurality of output drivers and wherein said second second reference voltage line is remote from said plurality of output drivers, in said second channel.

9. An integrated circuit output driver according to claim 1 wherein said first first reference voltage line is adjacent said plurality of output drivers and wherein said first second reference voltage line is remote from said plurality of output drivers, in said first channel.

10. An integrated circuit output driver according to claim 9 wherein said second second reference voltage line is adjacent said plurality of output drivers and wherein said second first reference voltage line is remote from said plurality of output drivers, in said second channel.

11. An integrated circuit output driver according to claim 9 wherein said second first reference voltage line is adjacent said plurality of output drivers and wherein said second second reference voltage line is remote from said plurality of output drivers, in said second channel.

12. An integrated circuit output driver system comprising:

a pair of first reference voltage lines:

a pair of second reference voltage lines; and a plurality of output drivers, each of which comprises an output node, a pull-up circuit which pulls up the output node in response to a pull-up input signal and a pull-down circuit which pulls down the output node in response to a pull-down input signal;

wherein the pull-up circuits and pull-down circuits of at least a first of said plurality of output drivers are respectively connected to one of the pair of first reference voltage lines and one of the pair of second reference voltage lines; and wherein the pull-up circuits and pull-down circuits of at least a second of said plurality of output drivers are respectively connected to the other of the pair of first reference voltage lines and the other of the pair of second reference voltage lines.

13. An integrated circuit output driver system according to claim 12 wherein said first reference voltage is a power supply voltage and wherein said second reference voltage is ground voltage.

14. An integrated circuit output driver system according to claim 12 further comprising a plurality of output pads, a respective output node being connected to a respective output pad.

15. An integrated circuit output driver system according to claim 12 wherein said pull-up input signal is an output data signal and wherein said pull-down input signal is the complement of said output data signal.

16. An integrated circuit output driver system according to claim 12 wherein said plurality of output drivers are sequentially arranged in the integrated circuit, and wherein alternating ones of said sequentially arranged output drivers are connected to one of the pair of first reference voltage lines and one of the pair of second reference voltage lines, and to the other of the pair of first reference lines and the other of the pair of second reference lines.

17. An integrated circuit output driver system comprising:

a plurality of output drivers, each of which drives an output node in response to an input signal, and each of which is powered by first and second reference voltages, the plurality of output drivers being sequentially arranged in the integrated circuit; and a pair of first reference voltage lines and a pair of second reference voltage lines which extend adjacent each of said output drivers, such that selected ones of said drivers are powered from one of the pair of first reference voltage lines and one of the pair of second reference voltage lines and selected others of said drivers are powered from the other of the pair of first reference voltage lines and the other of the pair of second reference voltage lines.

18. An integrated circuit output driver system according to claim 17 wherein said first reference voltage is a power supply voltage and wherein said second reference voltage is ground voltage.

19. An integrated circuit output driver system according to claim 17 further comprising a plurality of output pads, a respective output node being connected to a respective output pad.

20. An integrated circuit output driver system according to claim 17 wherein alternating ones of said sequentially arranged drivers are powered from one of the pair of first reference voltage lines and one of the pair of second reference voltage lines and alternating others of said sequentially arranged drivers are powered from the other of the pair of first reference voltage lines and the other of the pair of second reference voltage lines.

21. An integrated circuit output driver system comprising:

a plurality of output drivers, each of which drives an output node in response to an input signal, and each of which is powered by first and second reference voltages; and a pair of first reference voltage lines and a pair of second reference voltage lines each of which extend adjacent each of said output drivers, and which power said output drivers.

22. An integrated circuit output driver system according to claim 21 wherein said first reference voltage is a power supply voltage and wherein said second reference voltage is ground voltage.

23. An integrated circuit output driver system according to claim 21 further comprising a plurality of output pads, a respective output node being connected to a respective output pad.

24. An integrated circuit output driver system comprising:

a first pair of first and second reference voltage lines;

a second pair of first and second reference voltage lines which are spaced apart from said first pair of first and second reference voltage lines; and a plurality of output drivers between the spaced apart first and second pairs of first and second reference voltage lines, each of which drives an output node in response to an input signal, and each of which is powered by said first and second reference voltages.

25. An integrated circuit output driver system according to claim 24 wherein said first reference voltage is a power supply voltage and wherein said second reference voltage is ground voltage.

26. An integrated circuit output driver system according to claim 24 further comprising a plurality of output pads, a respective output node being connected to a respective output pad.

27. An integrated circuit output driver system according to claim 24 wherein alternating ones of said output drivers are powered by the respective first and second reference voltage lines in said respective first and second pair, and by the respective second and first reference voltage lines in said first and second pair, respectively.

28. An integrated circuit output driver system according to claim 24 wherein said first pair of first and second reference voltage lines extend parallel to one another, and wherein said second pair of first and second reference voltage lines extend parallel to one another.

* * * * *